US005249743A

United States Patent [19]

Leingang et al.

[11] Patent Number: 5,249,743

[45] Date of Patent: Oct. 5, 1993

[54] MULTIPLE SECTION SPECIAL TRACKWORK FASTENER

[75] Inventors: Charles J. Leingang; Robert F. Gildenston, both of Erie, Pa.

[73] Assignee: Lord Corporation, Erie, Pa.

[21] Appl. No.: 872,465

[22] Filed: Apr. 23, 1992

[51] Int. Cl.[5] ..... E01B 9/38

[52] U.S. Cl. ..... 238/283; 238/264

[58] Field of Search ..... 238/264, 282, 287, 306

[56] References Cited

U.S. PATENT DOCUMENTS

| | | | |
|---|---|---|---|
| 1,126,530 | 1/1915 | Liebmann . | |
| 1,550,584 | 8/1925 | Snyder . | |
| 2,424,916 | 7/1947 | Stedman | 238/283 |
| 3,576,293 | 4/1971 | Landis et al. | 238/287 |
| 3,724,754 | 4/1973 | Molyneux et al. | 238/349 |
| 3,784,097 | 1/1974 | Landis | 238/310 |
| 3,858,804 | 1/1975 | Hixson | 238/283 |
| 3,987,962 | 10/1976 | Robbins | 238/287 |
| 4,047,663 | 9/1977 | Reynolds et al. | 238/304 |
| 4,307,837 | 12/1981 | Leingang | 238/282 |
| 4,325,510 | 4/1982 | Sherrick | 238/341 |
| 4,765,538 | 8/1988 | Meyer | 238/283 |
| 4,844,338 | 7/1989 | Bucksbee | 238/283 |
| 5,022,584 | 6/1991 | Sherrick | 238/282 |

FOREIGN PATENT DOCUMENTS

| | | | |
|---|---|---|---|
| 922658 | 4/1963 | United Kingdom | 238/264 |

*Primary Examiner*—Robert J. Oberleitner
*Assistant Examiner*—S. Joseph Morano
*Attorney, Agent, or Firm*—Randall S. Wayland; Richard K. Thomson

[57] ABSTRACT

A special trackwork fastener (10) for supporting a railroad rail and attaching it to a support structure. The trackwork fastener (10) is modularly constructed and includes a top plate (20), resilient end portions (12) and (16), optional resilient center portion (14), and securing elements (18). The special trackwork fastener (10) has the versatility to be used in a large number of special trackwork situations such as turnouts, crossovers, crossings and switches or the like, which require a variety of lengths of trackwork fastener (10). The vertical compression stiffness and adjustability in length is provided by two opposed end portions (12),(16) and an optional center portion (14) which is molded or cut to length such that the portions collectively match the length of the top plate (20) and therefore the top plate (20) is fully supported along its length. The elastomer portions can be cored out to provide the desired compression stiffness.

20 Claims, 4 Drawing Sheets

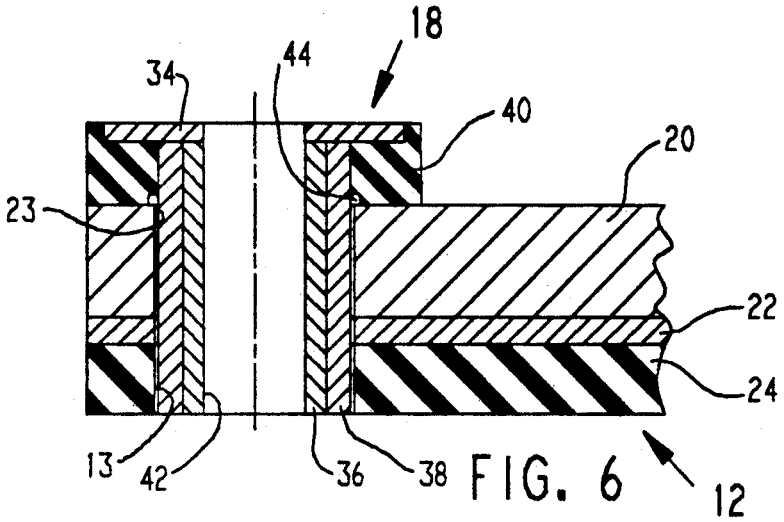
FIG. 6
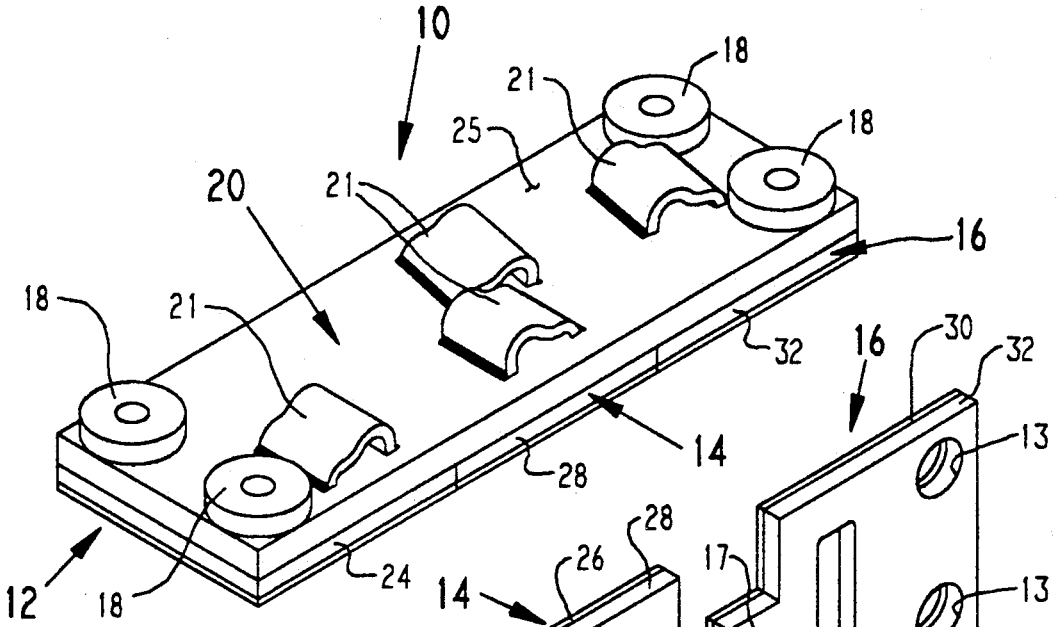
FIG. 7
FIG. 10
FIG. 9
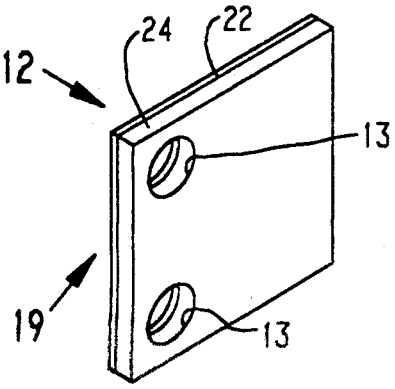
FIG. 8

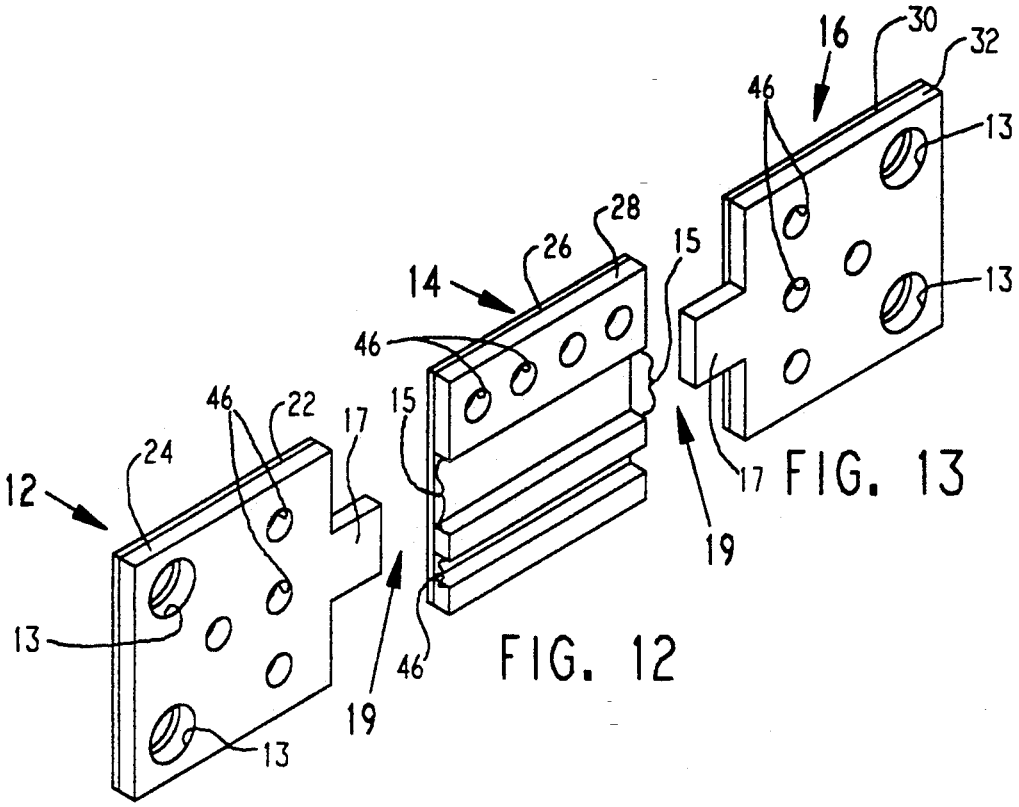
FIG. 13
FIG. 12
FIG. 11
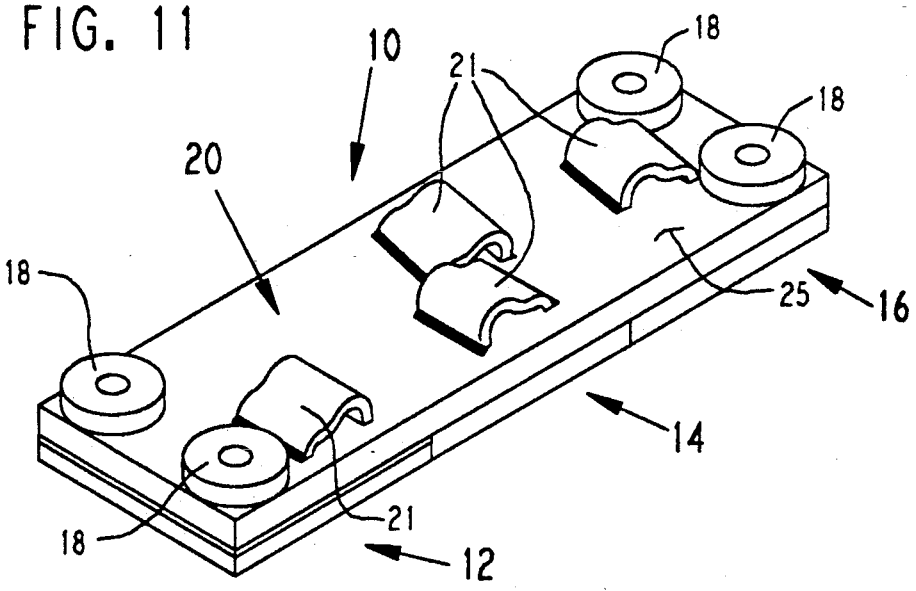
FIG. 14

MULTIPLE SECTION SPECIAL TRACKWORK FASTENER

FIELD OF THE INVENTION

The invention relates to the area of trackwork fasteners for railway rails. More particularly, the invention is directed to the area of elastomeric trackwork fasteners for supporting loads, providing vibration isolation, shock attenuation, and electrical insulation for the special trackwork areas of railways such as turnouts, crossovers, crossings and switches.

BACKGROUND OF THE INVENTION

In the olden days of railroad transportation, the rails were directly fastened to wooden railroad ties with railroad spikes. At turnouts, crossovers, crossings and switches, where there are special support and securing requirements, special fasteners were used to allow fastening of the rails to the support structure. Such special fasteners are described in U.S. Pat. No. 1,126,530 to Liebmann.

Trackwork fasteners of the resilient-type flexibly attach the railroad rail to a supporting structure such as a railroad tie or concrete abutment. Again, at turnouts, crossovers, crossings and switches, the problem arises of how to fasten the rail at these junctures. U.S. Pat. No. 2,424,916 to Stedman describes one such method which uses a resilient base plate. Rapid transit systems which have a high voltage third rail further require the trackwork fastener to insulate the rail from the support structure. In addition, the rail is resiliently supported to provide shock attenuation and vibration isolation of the support structure. One such resilient trackwork fastener for the abovementioned rapid transit installations is described in U.S. Pat. No. 3,576,293 to Landis. In all cases, a top portion of the trackwork fastener is secured to the rail by suitable means such as the spring clips described in the commonly assigned U.S. Pat. No. 4,307,837 issued to Leingang.

Further development in the area of resilient trackwork fasteners for turnouts, crossovers, crossings and switches led to the development of the trackwork fastener described in the commonly assigned U.S. Pat. No. 5,022,584 to Sherrick, which is herein incorporated by reference. Generally, a special trackwork fastener needs to be adaptable to a large number of special trackwork situations, it needs to be simple, cost effective and easily installed with as many standard components as possible. The trackwork fastener concept also needs to be such that it can be adapted and made to fit many special trackwork situations in the field.

SUMMARY OF THE INVENTION

In light of the requirements for a special trackwork fastener it is a primary object to provide an elastomeric assembly adaped for use with a top plate and which together comprise a special trackwork fastener for switches, turnouts, crossovers, crossings and the like which is simple, modular in construction, inexpensive to manufacture and substantially fully supports the top plate.

It is another object of the present invention to provide a special trackwork fastener which is modular and can be completely assembled to fit any particular special trackwork situation in the field.

It is another object of the present invention to provide a special trackwork fastener which is modular and has a number of standard components which are mechanically interlocked.

It is another object of the present invention to provide a special trackwork fastener which has a fully supported top plate.

It is another object of the present invention to provide a special trackwork fastener which is easier and lighter to handle.

It is another object of the present invention to provide a special trackwork fastener wherein one of the portions can be cut to size in the field.

It is another object of the present invention to provide a special trackwork fastener wherein at least one of the center portion and end portion is bonded in a variety of different lengths as standard components.

It is a feature of the present invention to provide an elastomeric assembly which is adapted for use with a top plate and together comprise a trackwork fastener which provides the abovementioned objects and which includes a first end portion, a second end portion, at least two securing elements and which may include a center portion. Further, means are provided to restrain movement of the end portions and center portion relative to the top plate.

It is an advantage of the trackwork fastener of the present invention that a number of standard modules or components can be assembled to fit any special trackwork requirement in the field, thus eliminating the need for specially made parts for each type of crossing, crossover, switch and turnout situation.

It is an advantage of the present invention trackwork fastener that the number of standard modules required to be assembled to to make up the trackwork assembly reduces the weight that must be moved at once by the assembler, i.e., a number of small pieces rather than one large one.

It is an advantage of the present invention trackwork fastener that the top plate of the trackwork fastener is substantially fully supported along its length.

Additional inventive features will become apparent after reading the accompanying detailed descriptions.

BRIEF DESCRIPTION OF THE DRAWINGS

FIG. 6 is an partial side sectioned view of the securing element used to fasten the top plate and end portions to the supporting structure;

FIG. 7 is an isometric view of another method of assembly of the trackwork fastener wherein the plates are adjacent the supporting structure;

FIG. 8 is an isometric view of an end portion of the trackwork fastener showing without a cored out area;

FIG. 9 is an isometric view of a center portion of the trackwork fastener showing the cored out area and the recess for accepting the tongue formed on an end portion;

FIG. 10 is an isometric view of an end portion of the trackwork fastener showing a cored out area and the tongue for accepting and meshing with the recess formed on the center portion;

FIG. 11 is an isometric view of an end portion of the trackwork fastener showing another type of cored out area and the tongue for meshing with the channel formed on the center portion;

FIG. 12 is an isometric view of a center portion of the trackwork fastener showing two types of cored out areas and the channel for accepting the tongue formed on an end portion;

FIG. 13 is an isometric view of an end portion of the trackwork fastener;

FIG. 14 is an isometric view of another embodiment of the trackwork fastener showing a molded end portion and center portion;

DETAILED DESCRIPTION OF THE INVENTION

Figure 1:
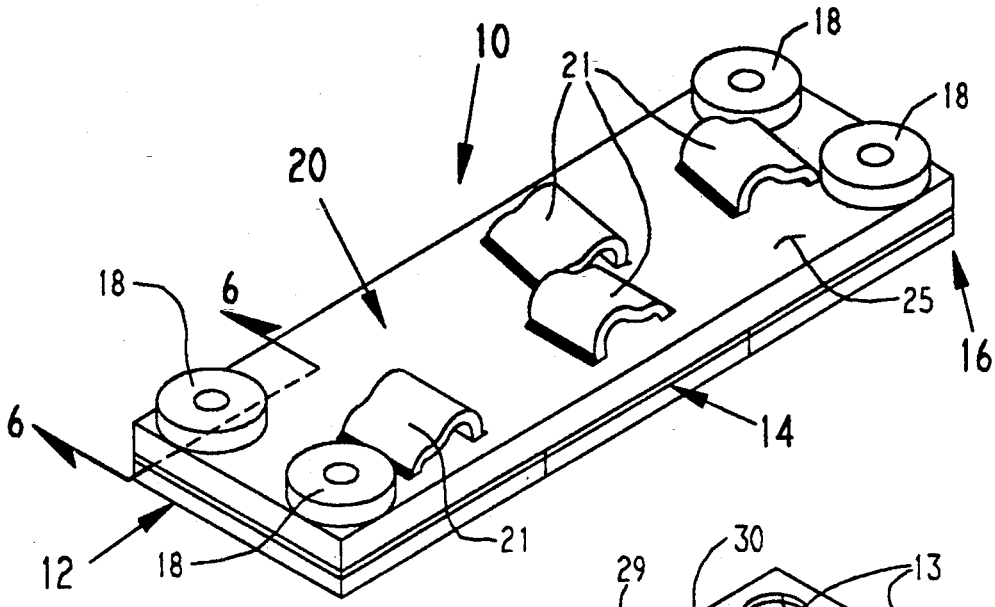
FIG. 1 is an isometric view of an embodiment of the trackwork fastener showing one method of assembly.

In the following, the invention will be described in detail with respect to the preferred embodiments, the attached illustrations, and drawings, wherein like elements will be designated by like reference numerals. The invention is a trackwork fastener of the elastomeric type for attaching a railroad rail to a support structure at special trackwork areas such as turnouts, crossovers, crossings, switches and the like.

Referring now to FIG. 1, a trackwork fastener 10 is shown which is comprised of a first end portion 12, a center portion 14, a second end portion 16, securing elements 18 and top plate 20. The top plate 20 includes a rail receiving surface 25 facing upward and a load bearing surface (not shown) opposing it, on the underside thereof said rail receiving surface 25. The top plate 20 includes means for securing a railroad rail to the load receiving surface 25, such as spring clip shoulders 21 or other suitable means. As will become apparent, in this trackwork fastener 10, the top plate 20 is substantially fully supported along its length and is adaptable and can be modified in the field to meet the requirements of a wide variety of special trackwork applications.

Figure 2:
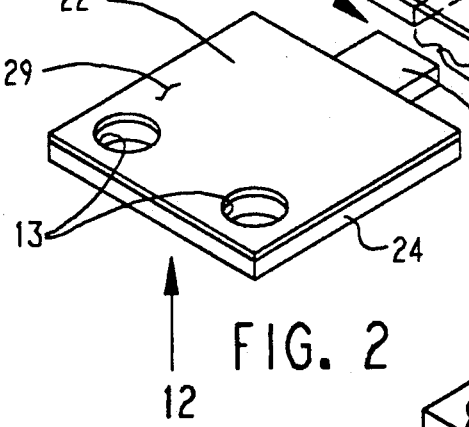
FIG. 2 is an isometric view of one end portion of the trackwork fastener.

Now referring to FIG. 2, a first end portion 12 is shown, including a first end plate 22, a first elastomer section 24 and at least one bore 13 through said first end portion 12 for accepting said securing element 18 (FIG. 1). The first end portion 12 includes a load receiving surface 29 on the first end plate 22 and a load reacting surface (not shown) on the opposite side, on the first elastomer section 24. Either of these surfaces can contact the underside or load bearing surface (not shown) of the top plate 20 (FIG. 1). The first end plate 22 is preferably stamped from hot or cold rolled steel and is between 0.125 and 0.375 inches in thickness.

The first elastomer section 24 is adjacent to said first end plate 22, and preferably manufactured by bonding or molding from neoprene elastomer, natural rubber elastomer, styrene-butadiene elastomer or urethane elastomer or the like. Preferably, there are two securing elements 18 through each first end portion 12, and there needs to be at least two securing elements 18 for the trackwork fastener 10, at least one per each of the first and second end portions 12 or 16. The elastomer section 24 is preferably bonded by a suitable process, such as injection molding, transfer molding, compression molding or post vulcanization (PV) bonding to the first end plate 22.

Figure 3:
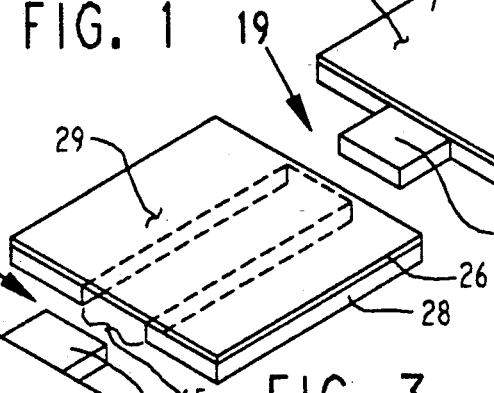
FIG. 3 is an isometric view of the center portion of the trackwork fastener showing the channel.

Now referring to FIG. 3, a center portion 14 is shown, including a center plate 26 and a center elastomer section 28. The center portion 14 includes a load receiving surface 29 and a load reacting surface (not shown) opposite it similar to the first end portion 12. A channel 15 is formed through center elastomer section 28 to mesh with tongue 17 on first end portion 12 (FIG. 1). Together tongue 17 and channel 15 act as means 19 for restraining movement of the center portion 14 and end portions 12 and 16 relative to the top plate 20 (FIG. 1). The securing elements 18 are used in conjunction with the tongues 17 and channels 15 and further act as means 19 for restraining movement of said first and second end portions 12 and 16 and center portion 14. The center plate 26 uses similar materials and processes as used for the first end portion 12 (FIG. 2). The channel 15 formed along the length of the center elastomer section 28 could also be formed by extrusion.

Figure 4:
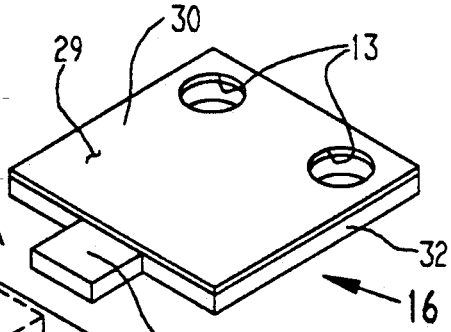
FIG. 4 is an isometric view of the other end portion of the trackwork fastener showing the tongue.

Now referring to FIG. 4, a second end portion 16 is shown which is identical to first end portion 12. The second end portion 16 also includes a load receiving surface 29 and a load reacting surface (not shown) opposite it, the same as first end portion 12 (FIG. 1). The second end plate 30 uses the same materials and processes as used for the first end portion 12 (FIG. 2).

Again, the securing elements 18 (FIG. 1) are accepted in the at least one bore 13 and preferably, there are two securing elements 18 (FIG. 1) inserted through the bores 13 in the second end portion 16. A tongue 17 on second end portion 16 interacts with channel 15. Together tongue 17 and channel 15 in conjunction with the securing means 18 (FIG. 1) act as means 19 for restraining movement of the center portion 14 and second end portion 16 relative to the top plate 20 (FIG. 1).

Figure 5:
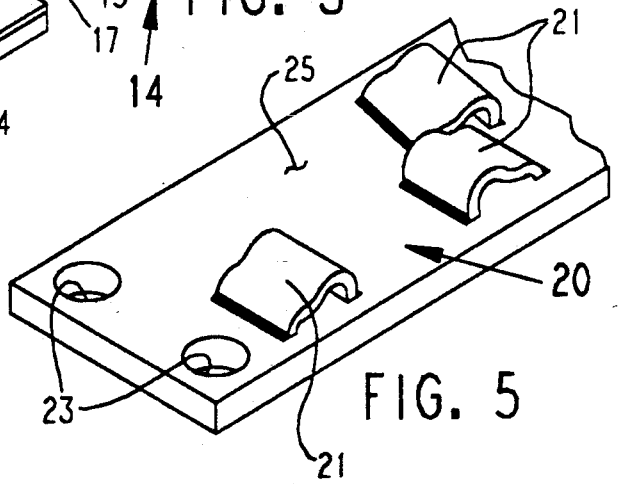
FIG. 5 is an isometric view of a portion of the top plate of the trackwork fastener.

Referring now to FIG. 5, wherein a top plate 20 is shown. The top plate 20 includes a rail receiving surface 25 which includes means for attaching a railroad rail on it, such as spring clip shoulders 21. The spring clip shoulders 21 are preferably welded to the top plate 20 and are formed for receiving spring clips, such as Pandrol® clips, which attach the railroad rail to the rail receiving surface 25. Other means for attaching the railroad rail to the top plate 20 are acceptable such as bolting or clamping, as is known to those skilled in the art. The underside of the top plate 20 includes a load bearing surface (not shown) which supports the loads and is in contact with the first portion 12, second portion 16 and center portion 14, if one is used.

A plurality of holes 23 formed through the top plate 20 receive the securing elements 18 (FIG. 1). Preferably there are two holes in each end of the top plate, but only one is required. Similarly, a slot would perform the same function. The top plate 20 can be made to any desired length and the center portion 14 (FIG. 2) can be cut or sawed to match a specified length in the field. The end portions 12 and 16 and the center portion 14, together, will then substantially fully support the top plate 20 throughout its length. This cut to length feature makes the trackwork fastener 10 (FIG. 1) easily adaptable to a wide variety of special trackwork applications. The top plate 20 is preferably stamped or flame cut from A36 steel and is between 0.6875 inches and 1.25 inches in thickness.

Now referring to FIG. 6, a securing element 18 is shown as it is installed. The securing element 18 includes a washer 34, preferably steel, a preferably steel inner member 36 including a bore 42 formed there through, a sleeve 38 of non-conducting material, preferably nylon, and an elastomer section 40 of preferably annular shape. The elastomer section 40 uses similar materials and processes as used for the first end portion 12 (FIG. 2). Undercut 44 allows the elastomer section 40 to be compressed without damaging the bond. The securing elements 18 are accepted in the at least one bore 13 in the first end portion 12 and the second end portion 16.

Bolting the securing element 18 through bore 42 to the supporting structure causes the load bearing surface (not shown) of the top plate 20 to contact the load receiving surface (not shown) on the first top plate 22 and slightly compress elastomer section 24 to urge the load reacting surface (not shown) into contact with the support structure. The sleeve 38 serves to insulate the inner member 36 from the top plate 20 and further act as a wear surface.

Referring now to FIG. 7, a trackwork fastener 10 is shown which is similar to the embodiment of FIG. 1 except, the first end portion 12, center portion 14 and second end portions 16 are flipped over such that the elastomer sections 24, 28, and 32 contact the top plate load bearing surface (not shown), when installed.

In FIG. 8, another embodiment of first end portion 12 is shown, including a first end plate 22, a first elastomer section 24 and at least one bore 13 there through. This first end portion 12 uses the same materials and processes as used for the first end portion 12 of (FIG. 2). Similarly, by using two securing elements 18 through the end portion 12, the end portion 12 is prevented from rotating relative to the top plate (FIG. 7). In essence, in this embodiment, the securing elements 18 act entirely as the means 19 for restraining movement relative to the top plate 20 (FIG. 7) because of the absence of the tongue 17.

Now referring to FIG. 9, another embodiment of center portion 14 is shown, including a center plate 26 and a center elastomer section 28. A recess 48 is formed on one end of the center portion 14 to mesh with tongue 17 on one of end portions 12 or 16 (FIG. 10). Together tongue 17 and recess 48 act as means for restraining movement 19 of the center portion 14 and end portions 12 relative to the top plate 20 (FIG. 1) when used in conjunction with securing elements 18 (FIG. 7). The center portion 14 (FIG. 9) is shown for illustration purposes with a recess 48 on one end and no channel 15 or recess 48 on the other. Again, this center portion 14 uses similar materials and processes as used for the first end portion 12 in (FIG. 2).

This embodiment further includes cored out areas 46 shown as rectangular shape and circular in shape. The size and shape of these cored out areas 46 can be adjusted to provide a desired spring rate per unit length. By way of example and not by limitation, the spring rate per unit length for all the portions is in the range of 10,000 lb/in/in–20,000 lb/in/in. Further, as shown by the left end of the center portion 14, no tongue or recess need be present. The means 19 for restraining movement could be an adhesive used to secure the center portion 14 to the top plate 20 in conjunction with securing elements 18.

Now referring to FIG. 10, a second end portion 16 is shown. The second end plate 30 uses similar materials and processes as used for the first end portion 12 in (FIG. 2). A tongue 17 on second end portion 16 interacts with recess 48. Together tongue 17 and recess 48 act as means 19 for restraining movement of the center portion 14 and second end portion 16 relative to the top plate 20 (FIG. 7). This embodiment further includes cored out areas 46 shown as having a rectangular shape.

Now referring to FIG. 11, another embodiment of first end portion 12 is shown which is similar to that of the second end portion 16 of FIG. 10. The first end portion 12 uses similar materials and processes as the aforementioned. The first end portion 12 further includes a tongue 17 which extends from the elastomer section 24 and is preferably formed entirely from elastomer. This embodiment further includes cored out area 46 shown as circular shapes.

Now referring to FIG. 12, another embodiment of center portion 14 is shown. A channel 15 is formed along the length of the center portion 14 to mesh with tongue 17 on one of end portions 12 or 16 (FIG. 11 and 13). This embodiment further includes cored out area 46 shown in channel-type and circular shapes. The channel-type cored out areas 46 may be formed by extrusion, where the round cored out areas 46 would be formed by a molding operation. The center portion 14 uses similar materials and processes as in the aforementioned.

Now referring to FIG. 13, a second end portion 16 is shown, which is identical to that of the first end portion 12 (FIG. 11).

Referring now to FIG. 14, a trackwork fastener 10 is shown which is comprised of a first end portion 12, a center portion 14 and a second end portion 16, securing elements 18, collectively referred to as the elastomeric assembly, and top plate 20. The center portion 14 can be cut to length in the field or it can be manufactured by bonding or molding to a predetermined length. In this embodiment, the center portion 14 and second end portion 16 is shown in an "as molded" condition. Furthermore, the center portion 14, or first end portion 12 or any one thereof could be manufactured by molding and not bonded.

Figures 15, 16:
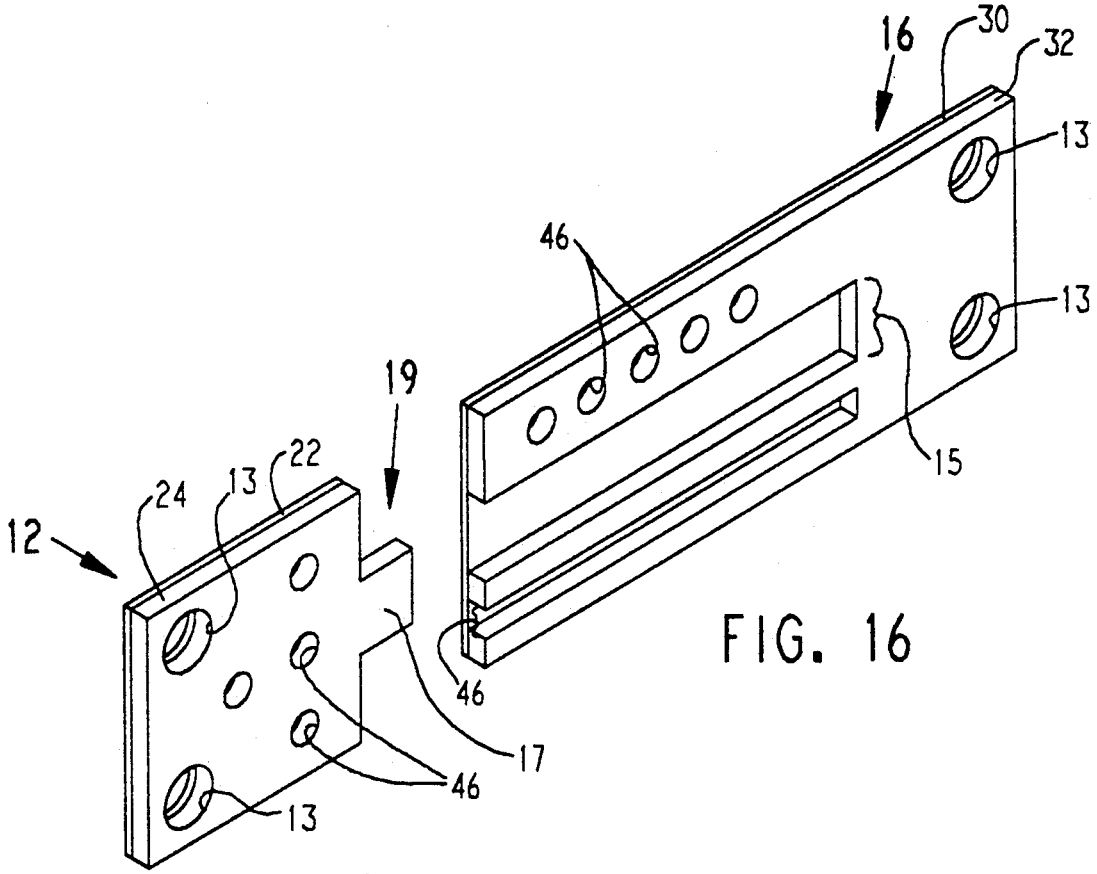
FIG. 15 is an isometric view of an end portion of the trackwork fastener.
FIG. 16 is an isometric view of another end portion of the trackwork fastener.

Now referring to FIG. 15, an embodiment of first end portion 12 is shown which is identical to the embodiment in FIG. 11.

Finally, referring to FIG. 16, a second end portion 16 is shown, including a second end plate 30, a second elastomer section 32 and at least one bore 13 therethrough. The second end portion 16 uses similar materials and processes as in the aforementioned. This embodiment functions similarly to the aforementioned second end portions 16, except it meshes with the first end portion 12 instead of a center portion 14. In essence, this embodiment is a combined end portion and center portion. Again, this embodiment can be cut to length in the field. In addition, it needs no channel 15 and can be used with a first end portion 12 such as in FIG. 8.

From the foregoing, it should be apparent that the present invention now provides a novel, inexpensive and very adaptable trackwork fastener for switches, turnouts, crossovers, frogs and the like which substantially fully supports the top plate along its length and provides the desired spring rate for vibration isolation and shock attenuation. While several embodiments of the present invention have been described in detail, various modifications, alterations and changes may be made without departing from the spirit and scope of the present invention defined in the appended claims.

What is claimed is:

1. A trackwork fastener for attaching a railroad rail to a support structure, comprising:

(a) a top plate including means for securing said railroad rail to a rail receiving surface, a plurality of holes formed through said top plate, said top plate including a load bearing surface opposite said rail receiving surface;

(b) a first end portion for supporting said top plate including a first end plate and a first elastomer section adjacent thereto, at least one bore formed through said first end plate and said first elastomer section, said first end plate having a load receiving surface and said first elastomer section having a load reacting surface opposing said load receiving surface, said load receiving surface of said first end plate contacting said load bearing surface of said top plate;

(c) a second end portion for supporting said top plate including a second end plate and a second elastomer section adjacent thereto, at least one bore formed through said second end plate and said second elastomer section, said second end plate having a load receiving surface and said second elastomer section having a load reacting surface opposing said load receiving surface, said load receiving surface of said second end plate contacting said load bearing surface of said top plate;

(d) a center portion for supporting said top plate including a center plate and a center elastomer section adjacent thereto, said center plate having a load receiving surface and said center elastomer section having a load reacting surface opposing said load receiving surface, at least one of said center portion and said first and second end portions including means for restraining movement of said first and second end portions and said center portion relative to said top plate, said load receiving surface of said center plate contacting said load bearing surface of said top plate; and (e) at least two securing elements for securing said top plate relative to said support structure, one of said at least two securing elements extending through one of said plurality of holes in said top plate and then through said at least one bore formed through said first end portion, another of said at least two securing elements extending through another of said plurality of holes in said top plate and then through said at least one bore formed through said second end portion.

2. A trackwork fastener for attaching a railroad rail to a support structure as recited in claim 1 wherein said means for securing said rail include spring clip shoulders which are adapted for use with spring clips.

3. A trackwork fastener for attaching a railroad rail to a support structure as recited in claim 2 wherein said spring clip shoulders are welded to said top plate.

4. A trackwork fastener for attaching a railroad rail to a support structure as recited in claim 1 wherein said at least one bore formed through said first end plate and said at least one bore formed through said second end plate each includes at least two bores in each said end plate for receiving said securing elements.

5. A trackwork fastener for attaching a railroad rail to a support structure as recited in claim 1 wherein said first elastomer section is made from one material selected from the group consisting essentially of natural rubber elastomer, neoprene elastomer, urethane elastomer and styrene-butadiene elastomer.

6. A trackwork fastener for attaching a railroad rail to a support structure as recited in claim 1 wherein said top plate is manufactured from plate steel having a thickness range between 0.6875 and 1.25 inches.

7. A trackwork fastener for attaching a railroad rail to a support structure as recited in claim 1 wherein said first plate is manufactured from plate steel having a thickness range between 0.125 and 0.375 inches.

8. A trackwork fastener for attaching a railroad rail to a support structure as recited in claim 1 wherein said means for restraining movement of said center portion relative to said top plate includes a channel and a tongue.

9. A trackwork fastener for attaching a railroad rail to a support structure as recited in claim 1 wherein said means for restraining movement of said center portion relative to said top plate includes a tongue and a recess.

10. A trackwork fastener for attaching a railroad rail to a support structure as recited in claim 1 wherein said means for restraining movement of said center portion relative to said top plate includes an adhesive securing said center portion to said top plate.

11. A trackwork fastener for attaching a railroad rail to a support structure as recited in claim 1 wherein said means for restraining movement of said first and second end portions relative to said top plate includes at least two securing elements extending first through said top plate and then through said first and second end plates, respectively.

12. A trackwork fastener for attaching a railroad rail to a support structure as recited in claim 1 wherein at least one of said center portion and said first and second end portions includes a cored out area.

13. A trackwork fastener for attaching a railroad rail to a support structure as recited in claim 1 wherein said center portion exhibits a spring rate per unit length between the ranges of 10,000–20,000 pounds/inch/inch.

14. A trackwork fastener for attaching a railroad rail to a support structure as recited in claim 1 wherein said at least two securing elements are further comprised of a washer, an inner member, a non-conducting sleeve and an elastomer section.

15. A trackwork fastener for attaching a railroad rail to a support structure, comprising:

(a) a top plate having means for securing said railroad rail to a rail receiving surface, a plurality of holes formed through said top plate, said top plate having a load bearing surface opposite said rail receiving surface;

(b) a first end portion for supporting said top plate including a first end plate and a first elastomer section adjacent thereto, at least one bore formed through said first end plate and said first elastomer section, said first end plate having a load receiving surface and said first elastomer section having a load reacting surface opposing said load receiving surface, said load reacting surface of said first elastomer section contacting said load bearing surface of said top plate;

(c) a second end portion for supporting said top plate including a second end plate and a second elastomer section adjacent thereto, at least one bore formed through said second end plate and said second elastomer section, said second end plate having a load receiving surface and said second elastomer section having a load reacting surface opposing said load receiving surface, said load reacting surface of said second elastomer section contacting said load bearing surface of said top plate;

(d) a center portion for supporting said top plate including a center plate and a center elastomer section, said center plate having a load receiving surface and said center elastomer section having a load reacting surface opposing said load receiving surface, said center portion including means for restraining movement of said center portion relative to said top plate, said load reacting surface of said center elastomer section contacting said load bearing surface of said top plate; and (e) at least two securing elements for securing said top plate to said support structure, one of said at least two securing elements extending through one of said plurality of holes in said top plate and then through said at least one bore formed through said first end portion, said other of said at least two securing elements extending through another of said plurality of holes in said top plate and then through said at least one bore formed through said second end portion, said securing elements further having a bore formed therethrough.

16. An elastomeric assembly adapted for use with a top plate for attaching a railroad rail to a support structure, comprising:

(a) a first end portion for supporting said top plate including a first end plate and a first elastomer section adjacent thereto, at least one bore formed through said first end plate and said first elastomer section, said first end plate having a load receiving surface and said first elastomer section having a load reacting surface opposing said load receiving surface, one of said load reacting surface of said first elastomer section and said load receiving surface of said first end plate formed for contacting a load bearing surface of said top plate;

(b) a second end portion for supporting said top plate including a second end plate and a second elastomer section adjacent thereto, at least one bore formed through said second end plate and said second elastomer section, said second end plate having a load receiving surface and said second elastomer section having a load reacting surface opposing said load receiving surface, one of said load reacting surface of said second elastomer section and said load receiving surface of said second end plate formed for contacting a load bearing surface of said top plate;

(c) a center portion formed to support said top plate including a center plate and a center elastomer section adjacent thereto, said center plate having a load receiving surface and said center elastomer section having a load reacting surface opposing said load receiving surface, said center portion including means for restraining movement of said center portion relative to said top plate, one of said load reacting surface of said center elastomer section and said load receiving surface of said center plate formed for contacting a load bearing surface of said top plate;

(d) at least two securing elements formed to be received by said at least one bore in each of said first and said second end portions and in said plurality of holes through said top plate.

17. An elastomeric assembly adapted for use with a top plate for attaching a railroad rail to a support structure, comprising:

(a) a first end portion for supporting said top plate, said first end portion including a first elastomer section and at least one bore formed therethrough, said first end portion having a load receiving surface and a load reacting surface opposing said load receiving surface, one of said load reacting surface of said first portion and said load receiving surface of said first portion formed for contacting said top plate;

(b) a second end portion for supporting said top plate, including a second elastomer section and at least one bore formed therethrough, said second end portion including a load receiving surface and a load reacting surface opposing said load receiving surface, one of said load reacting surface of said second end portion and said load receiving surface of said second end portion formed for contacting said top plate, said second end portion being movable relative to said first end portion in a direction which is generally transverse to said railroad rail;

(c) at least one of said first and said second end portions including means for restraining movement of said first and second end portions relative to said top plate; and (d) at least two securing elements formed to be received by said at least one bore in each of said first and second end portions;

whereby said top plate is substantially fully supported.

18. An elastomeric assembly as recited in claim 17 wherein a tongue on said first end portion engages in a channel in said second end portion to restrain undesired movement while permitting lateral adjustment between said first and second end portions.

19. An elastomeric assembly adapted for use with a top plate for attaching a railroad rail to a support structure, comprising:

(a) a first end portion for supporting said top plate, said first end portion including a first elastomer section and means for restraining movement relative to said top plate, said first end portion having a load receiving surface and a load reacting surface opposing said load receiving surface, one of said load reacting surface of said first portion and said load receiving surface of said first portion formed for contacting said top plate;

(b) a second end portion for supporting said top plate, including a second elastomer section and means for restraining movement relative to said top plate, said second end portion including a load receiving surface and a load reacting surface opposing said load receiving surface, one of said load reacting surface of said second end portion and said load receiving surface of said second end portion formed for contacting said top plate, said second end portion being movable relative to said first end portion in a direction which is generally transverse to said railroad rail;

(c) means for attaching said first and second end portions to said top plate;

whereby said top plate is fully supported along its length.

20. An elastomeric assembly as recited in claim 19 wherein a tongue on said first end portion engages in a recess in said second end portion to restrain undesired movement while permitting lateral adjustment between said first and second end portions.

* * * * *